US005683294A

United States Patent [19]

Maines

[11] Patent Number: 5,683,294

[45] Date of Patent: Nov. 4, 1997

[54] TEMPORARY BRATTICE FOR MINES

[76] Inventor: Teddy Maines, 281 E. Third South, Green River, Wyo. 82935

[21] Appl. No.: 710,391

[22] Filed: Sep. 16, 1996

[51] Int. Cl.[6] ..... E21F 1/14

[52] U.S. Cl. ..... 454/170; 299/12

[58] Field of Search ..... 454/169, 170; 299/12

[56] References Cited

U.S. PATENT DOCUMENTS

| | | | |
|---|---|---|---|
| 1,594,921 | 8/1926 | Barnett . | |
| 1,766,324 | 6/1930 | Berner . | |
| 3,863,554 | 2/1975 | Boyd . | |
| 4,009,649 | 3/1977 | Thimons et al. . | |
| 4,023,372 | 5/1977 | Presler et al. | 454/170 X |
| 4,175,481 | 11/1979 | Burgess, Jr. . | |
| 4,282,802 | 8/1981 | Divers et al. | 454/170 |
| 4,440,070 | 4/1984 | Baker et al. | 454/170 |
| 4,494,894 | 1/1985 | Divers et al. | 454/170 X |
| 4,612,848 | 9/1986 | Pollack | 454/170 |
| 4,770,086 | 9/1988 | Gabster | 454/170 |
| 5,024,262 | 6/1991 | Huang . | |
| 5,398,467 | 3/1995 | Ricq et al. . | |

FOREIGN PATENT DOCUMENTS

| | | |
|---|---|---|
| 0060430 | 3/1975 | Australia . |
| 2358261 | 7/1975 | Germany . |
| 1694924 | 11/1991 | U.S.S.R. . |

*Primary Examiner*—Harold Joyce
*Attorney, Agent, or Firm*—Richard C. Litman

[57] ABSTRACT

A brattice for temporary or emergency use in underground mining provides a quickly and easily installable partition to close off drifts or tunnels as desired to control ventilation through the mine in an emergency, or for routine temporary use in the mine. The brattice comprises a brattice curtain formed of a thin, lightweight, fire resistant material, such as a synthetic fabric, with a peripheral spring frame installed therearound. The spring frame provides an expanding force urging the brattice curtain to a fully extended configuration, but the frame may be twisted and folded one or more times to twist and fold the attached brattice curtain for compact storage within a storage container or other convenient storage. Generally central and/or peripheral selectively openable closures may be provided in the curtains, for the passage of ventilation ducts, personnel, and other articles as required. Mating attachment of plural brattices may be provided, to span larger openings than the span of a single brattice. The curtain may also include a light, flexible extension beyond the spring frame, which may be tucked into irregular gaps for better sealing. The present brattice may be twisted and folded for compact storage, alone or with one or more additional brattices. A storage container or bag may be provided, if desired. The brattice is very light weight, and plural brattices may be stored at convenient locations throughout the mine or quickly carried into the mine, where they may be erected quickly for temporary or emergency ventilation control as required.

17 Claims, 4 Drawing Sheets

TEMPORARY BRATTICE FOR MINES

BACKGROUND OF THE INVENTION

1. Field of the Invention

The present invention relates generally to brattices, or panels used in underground mining for ventilation control, and more specifically to a temporary brattice which is quickly installable across a mine drift or tunnel to control ventilation through the mine in the event of a mining accident or for other temporary use. The brattice has a periphery including a spring band therein, which quickly springs to a fully extended state when unfolded. Two or more brattices may be connected together as required, by means of cooperating hook and loop fastening material thereon. Zippers or additional hook and loop material closures may be provided to serve as passages for ventilation ducts, cables, and emergency workers and miners as required. The brattices may be made inexpensively, so as to be economically disposable when no longer needed.

2. Description of the Prior Art

The commercial underground mining of various minerals and materials conventionally uses the room and pillar method of extracting ore. This method comprises cutting a network of spaced apart drifts in the plane of the ore bed perhaps hundreds of feet below the surface, generally in an orthogonal grid, with columns or pillars of ore left remaining for support of the overlying material.

Generally, only two or at the most a very few shafts are sunk from the surface to access the actual mining activity and to bring the ore to the surface. These shafts are also used to draw air into the mine and to extract air from the mine for ventilation. Mine engineers and mechanics determine the desired airflow path through the drift network, and brattices (partitions blocking airflow at various points and junctures in the drift network) are installed to control the airflow through the mine.

This system works well under normal circumstances, and mining engineers have developed a good understanding of the structural strength required to support the drift network which has been excavated in such mines, depending upon the type of ore being mined, as well as the ventilation requirements. While the underground mining industry is reasonably safe, considering the working environment, there nevertheless exists a certain amount of hazard from potential collapse of portions of the overlying material for whatever reason.

An example of such is the accident which occurred in February, 1995 at the Solvay Minerals mine near Green River, Wyo., due to a nearby earthquake which occurred along a fault previously believed to be inactive. The result was the collapse of approximately ¾ of a mile of the drift network of the mine, some 1500 feet below the surface, the destruction of a substantial portion of the ventilation system of the mine, and the release of some 3.5 billion cubic feet of methane gas as well as ammonia vapor into the underground drift network.

There were some 57 miners beneath the surface at the time of the collapse, and all but two were brought to the surface relatively quickly. Emergency rescue teams entered the mine, carrying large, heavy, and cumbersome brattices to set up an emergency ventilation plan and close off areas of the mine which were venting methane and/or other hazardous gases. This work must be accomplished manually, with no power equipment being used due to the explosion hazard of the methane gas being released. The present emergency brattice devices being used are not only relatively heavy and bulky, but also require some time for setup due to the spring loaded pole method which is used to support the brattice curtains currently used. These curtains also lack any opening means for the passage of temporary ventilation ducts therethrough, and/or means for the passage of rescue or other personnel therethrough; they must be pulled at least partially open, with a relatively large gap remaining, to allow such passage.

The above procedures eventually led to the recovery of the remaining two miners. However, one of those persons died during the return trip to the surface. This tragedy might well have been averted if rescue workers could have proceeded more rapidly through the mine, quickly erecting emergency brattices and controlling the ventilation sooner throughout the remaining drift network. The present inventor is employed in the mining industry, and was involved in the above described accident and rescue. Accordingly, she is well aware of the deficiencies of the conventional emergency brattice system, and the need for improvements thereto.

Accordingly, a need is seen for emergency brattices for mines, which comprise a lightweight but fire resistant sheet material, such as a synthetic fabric, having a periphery with a spring-like band therearound. The peripheral band may be twisted and folded over itself, to form a smaller size loop which may be stored in a storage bag or container until needed. An additional extension flap of material may be provided beyond the spring band, providing for better sealing of the brattice to surface irregularities in the drift wall. The brattice curtain itself may include closable passages therethrough, using hook and loop fastening material (e.g., Velcro, tm) and/or zippers, to provide for ventilation ducts, cables, and for the passage of personnel therethrough. Two or more brattice curtains may be secured together using mating hook and loop material, or other means as desired. A discussion of the prior art of which the present inventor is aware, and its distinctions from the present invention, is provided below.

U.S. Pat. No. 1,594,921 issued on Aug. 3, 1926 to Joel F. Barnett describes a Mine Brattice comprising a plurality of slidably adjustable metal sheets. The device is adapted for permanent installation, as indicated by the description of the use of concrete to anchor the device. Also, metal is not a desired material for use in emergency mine ventilation control, due to the explosive mixture of gases which often occurs. While the present brattice is not perfectly air tight, it serves as a temporary or emergency measure, and is lightweight, quickly erectable and removable, and cannot produce sparks in an explosive atmosphere, U.S. Pat. No. 1,766,324 issued on Jun. 24, 1930 to Vernon T. Berner describes a Brattice having a complex, generally two dimensional skeletal branching framework which extremities capture the edges of a brattice curtain against the irregular surface of the drift or tunnel being sealed. The curtain includes a peripheral inflatable seal to provide a tight seal against the irregular walls of the tunnel. No peripheral structural frame is provided, as in the present invention, and Berner does not provide any passages or other openings through his brattice. No passage of personnel through the Berner brattice is possible, due to the branching skeletal framework provided. The Berner device is relatively complex and time consuming to erect and remove, and is not economically disposable due to its complex structure.

U.S. Pat. No. 3,863,554 issued on Feb. 4, 1975 to Newton A. Boyd describes Portable Mine Stoppings, comprising brattice cloth material sealed to the surface of the mine drift by a peripheral metal strap. Additional heavy metal bracing (jackscrews, posts, etc.) is disclosed. The bracing is intended to supplant other permanent brattice means, such as mortared cinder block walls, and thus is a permanent, rather than a temporary, structure. Accordingly, Boyd provides a zippered passage in his panel, but the bracing could extend thereacross to make it difficult to use. The heavy metal bracing of the Boyd brattice, and the time consuming erection procedure, renders it unsuitable for emergency use, where it must be carried into the mine and erected rapidly in a potentially explosive atmosphere.

U.S. Pat. No. 4,009,649 issued on Mar. 1, 1977 to Edward D. Thimons et al. describes a Mine Ventilation Control Device, comprising a brattice cloth sheet with a plurality of relatively weaker straps extending from the periphery thereof. The straps are permanently secured to the walls of the drift, and serve as weak links in the event of a large pressure differential on opposite sides of the brattice curtain. The straps are easily replaced, or secondary straps reinstalled, without damage to the curtain itself. The device is thus intended for normal use in a working mine using explosives for excavation of the ore, rather than for use as an emergency brattice. The need to drive bolts or other fasteners into the walls of the drift would require excessive time, and could prove hazardous in an explosive atmosphere.

U.S. Pat. No. 4,175,481 issued on Nov. 27, 1979 to James V. Burgess, Jr. describes a Mine Ventilation System And Elements Thereof, comprising a brattice curtain with either separate or attached, vertically hanging retaining members. The retainers are flexible tubular elements which are filled with a massive material (rubble or other debris, water, etc.) and serve to provide a resistive mass precluding excessive movement of the curtain. No spring periphery is disclosed, as in the present emergency brattice. The Burgess, Jr. retaining columns, while very light in weight in their empty state, would require an excessive amount of time to fill, rendering impractical their use in an emergency situation. No passages, plural panel attachment means, or peripheral extensions are disclosed by Burgess, Jr.

U.S. Pat. No. 4,440,070 issued on Apr. 3, 1984 to Paul V. Baker et al. describes a Mobile Adjustable Curtain Apparatus For Use In Room And Pillar Coal Mining Ventilation System. The drawings of the Baker et al. patent indicate that the device is intended for use in the control of ventilation under normal mining conditions, rather than for emergency use, as in the present brattice. The Baker et al. apparatus is quite bulky and heavy, and relies upon wheels for portability. Hydraulic jacks are used to raise the top of the curtain to the drift ceiling, with a plurality of spring loaded extensions being used to provide closer conformity with irregularities in the ceiling. The entire apparatus thus cannot be carried into the mine by emergency rescue crews, and is very time consuming to set up. The wheels cannot be used in rough areas, as where a portion of the roof has fallen.

U.S. Pat. No. 4,770,086 issued on Sep. 13, 1988 to Jeffrey C. Gabster describes a Portable Ventilation Safety Device comprising a rigid lower horizontal frame member with opposite vertical members extending upwardly therefrom to support the brattice curtain. The rigid frame members are relatively heavy and cannot be easily and rapidly carried into a mine and set up rapidly, as provided by the present emergency brattice. The purpose of the Gabster brattice is essentially the same as that of the Baker et al. device discussed above, i. e., to be advanced toward the working face of the drift as the drift is extended by normal mining operations, and parallel with the drift to direct air flow on opposite sides of the curtain, to and from the working face.

U.S. Pat. No. 5,024,262 issued on Jun. 18, 1991 to En L. Huang describes a Compactly Foldable Automobile Sunshade, comprising a spring loop periphery with a layer of sheet material extending thereacross. The general operative principal is similar to that of the present emergency brattice for mining, but Huang teaches away from the present invention by failing to provide any openings through his sunshade, or means of connecting plural shades to one another. Such openings and connecting means would be undesirable in a sunshade, where an unbroken sheet is desirable to reduce solar radiation and convection through the sheet, and the relatively small glass area of an automobile renders unnecessary the joining of two or more shades to one another. The present brattice provides openings and mutual attachment means, as well as preferably being devoid of any metal to preclude the possible generation of sparks therefrom. The various semirectangular shapes disclosed by Huang may also be incorporated in the present brattice, as desired, and are known to those skilled in the art, U.S. Pat. No. 5,398,467 issued on Mar. 21, 1995 to Sano Ricq et al. describes a Fire Barrier Aeration Device With Static Elements. The device is installed in the wall of a cable or the like, to allow the interior of the article to "breathe" under normal circumstances. The device expands to close the passage under extreme heat. No relationship is seen to the present emergency brattice, other than that the present brattice may be formed of fire resistant materials.

German Patent Publication No. 2,358,261 published on Jul. 24, 1975 illustrates a procedure for erecting barriers in underground roadways, for diverting ventilating air or to protect against methane gas. The barrier is a hollow elastic device, which is inflated to distend against the walls of the tunnel. Selectively openable flaps are provided for passage through the barrier. The present brattice has no inflation means, and does not require inflation or any other mechanical operation other than releasing the spring tension in the coiled peripheral frame, in order to erect it across a drift or other site.

Australian Patent Publication No. 60,430 published on Mar. 20, 1975 describes Improvements In Or Relating To Mine Brattices. This Australian Patent Publication '430 is the parent disclosure for the German '261 publication discussed above, and the same points apply here as to the German publication.

Finally, Soviet Patent Publication No. 1,694,924 published on Nov. 30, 1991 illustrates a mine shaft stopping using resilient sealing elements of three sided prism shape, assembled together. The stopping must be laboriously constructed and cannot be quickly and easily erected, as can the present emergency brattice. The individual components are quite bulky, and cannot be easily carried into a mine complex. The Soviet stopping is not suited for emergency use, as is the present brattice invention.

None of the above inventions and patents, taken either singly or in combination, is seen to describe the instant invention as claimed.

SUMMARY OF THE INVENTION

Accordingly, it is a principal object of the invention to provide an improved temporary brattice for mines, comprising a brattice curtain of a thin sheet of material having a periphery with a spring frame therein and which curtain and frame are formed of approved materials and devoid of metallic elements.

It is another object of the invention to provide an improved temporary brattice which peripheral spring frame and brattice curtain are adapted to be twisted and folded for compact storage, and which may include a storage container therefor.

It is a further object of the invention to provide an improved temporary brattice which may include selectively openable generally central and peripheral passages therethrough, for the passage of ventilation ducts, personnel, and other articles therethrough.

An additional object of the invention is to provide an improved temporary brattice which is selectively securable to another like brattice, to span larger areas than that which a single brattice is capable of spanning.

Still another object of the invention is to provide an improved temporary brattice which may include a peripheral brattice curtain extension beyond the spring periphery, with the extension being adapted to close irregular gaps.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
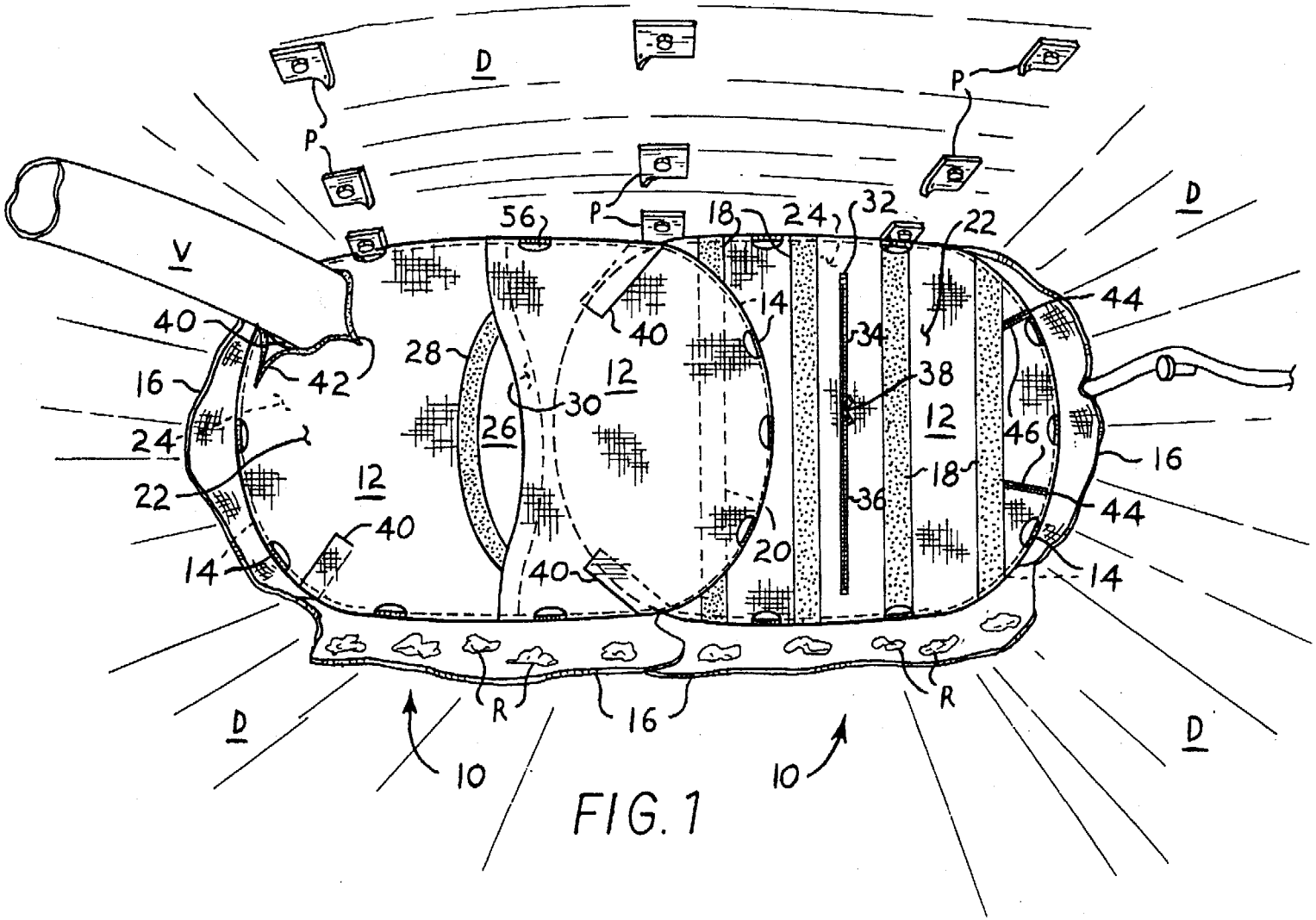
FIG. 1 is a front elevation view of a pair of the present temporary or emergency brattices joined to span a drift in a mine, and showing various features of the present brattice invention.

FIG. 1 provides a front elevation view of the present temporary or emergency brattice invention, installed as a pair of brattices 10 providing temporary control of air flow through a mine drift D. Each brattice 10 of FIG. 1 has a generally oval shape which is developed by the shape of the thin, flexible brattice curtain 12 which is stretched over a peripheral spring member (It will be seen that other shapes may be provided as desired, according to the shape of the brattice curtain and its peripheral pocket which holds the spring member therein.) The spring member 14 seeks to extend to a natural linear, extended state due to the spring forces incorporated therein. As the spring member 14 is in the form of a closed loop, its fully expanded state is a circle, with that circular loop being modified according to the shape the capturing periphery of the brattice curtain secured thereto.

The brattice curtain material 12 extending across the peripheral spring 14 is preferably light in weight, in order to allow a worker to carry several such temporary or emergency brattices 10 without undue strain. Such materials as a ripstop synthetic fabric having periodically spaced heavier fibers, works well. In any event, it is desirable that the material be fire resistant and meet standards of the federal Mining Safety and Health Administration for such purposes. While the material may be coated, very slight porosity is not critical in an emergency environment, as the present brattices 10 are intended for temporary or emergency use, and uncoated material is lighter in weight.

The peripheral spring material is also of some importance, due to the potentially explosive gases released in many mining accidents. The spring may be formed of a flat ribbon of resilient plastic or composite material (fiber glass, carbon fiber, etc.) in order to avoid the use of metal which might generate an electrical spark. Other components which may be incorporated with the present brattices and discussed further below may also be free of any metals, for the same reason.

In large commercial mines using automated mining equipment, "drifts" or tunnels are cut using boring (longitudinal) and drum (lateral) mining machines. longitudinal boring creates a drift with a circular cross section, which is typically widened to an oval section by making two or more closely spaced passes with the mining machine. Drum type machines form drifts and rooms having rectangular cross sections, with substantially square corners. The flexible nature of the present brattice 10, with its highly flexible peripheral spring band 14, enables the brattice 10 to be manipulated to conform reasonably closely to the contours of virtually any drift configuration.

Additional sealing may be achieved by providing a brattice curtain extension 16, extending outwardly from the peripheral brattice curtain sleeve which retains the peripheral spring member 14. This extension flap 16 may be tucked into any irregular contours, cracks, crevices, etc., and/or secured with rocks and/or rubble R on the floor of the drift D, to provide additional sealing as shown in FIG. 1 and in the cross sectional view of FIG. 4.

As noted further above, the typical drift is considerably wider than its height, due to multiple overlapping passes of a longitudinal boring machine, or to the width of the lateral drum mining machine. A nominal size for such drifts might be nine by twelve feet, with the height and width depending upon the diameter of the mining machine and the amount of overlap between passes and the number of passes, which in turn is determined by structural considerations. Accordingly, it may be necessary to provide two (or more) overlapping brattices 10 to seal such a drift D, as shown in FIG. 1. Better sealing of overlapping brattices 10 is accomplished by providing mating portions of hook and loop fastening material 18 and 20 (e.g., Velcro, tm) on the first and opposite second surfaces 22 and 24 of each brattice curtain 12.

Figure 6:
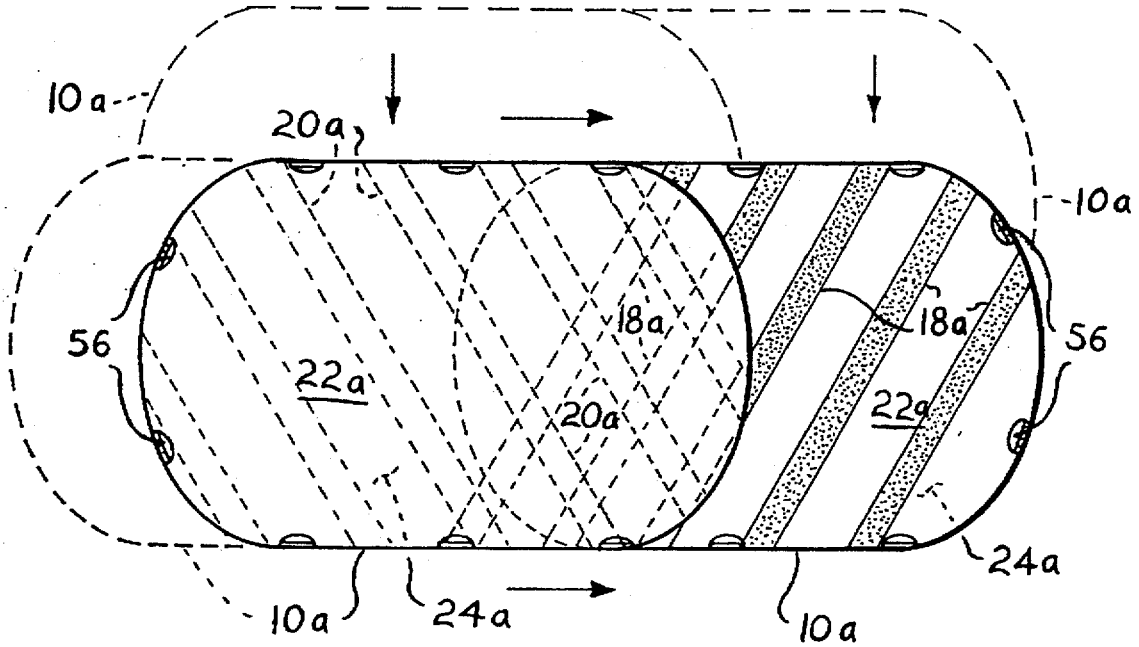
FIG. 6 is a schematic view of an overlapping pair of the present temporary or emergency brattices joined together, showing an alternate attachment configuration.

These strips of material 18 and 20 may be disposed generally vertically over the respective surfaces 22 and 24 of each brattice curtain 12, as shown in FIG. 1. However, such a configuration requires each fastener strip to be aligned generally along each mating strip of the mating brattice 10, with no adhesion occurring if the two brattices overlap with a strip of hook and loop material resting along the cloth of the overlapping brattice. FIG. 6 is a view of an alternate configuration, in which the hook and loop fastener strips 18*a* and 20*a* are disposed diagonally over their respective brattice curtain surfaces 22*a* and 24*a* of a pair of brattices 10*a*. In this manner, at least a portion of the mating strips will always be in contact with one another to secure the brattices 10*a* together, and overlap of the panels 10*a* is not critical.

It is often necessary to pass various ducts, lines, and even personnel through either temporary or permanently installed brattices, and accordingly, passages adapted for such purposes may be provided in the present brattices 10, as shown in figure Preferably, such passages are symmetrically disposed through the brattice curtains 12, in order that no additional time be required to position the brattices 10 in a specific orientation during their installation, as time is often critical in the environment of use of the present brattices 10. Accordingly, a personnel passage 226 may be provided, as shown in the left brattice 10 of FIG. 1, extending across the minor diameter of the brattice 10 and centered symmetrically within the brattice curtain 12. Closure may be means of mating hook and loop fastening material strips 28 and 30.

Alternatively, a closure passage 32 may be provided, as shown in the right hand brattice 10 of FIG. 1, using a zipper. Again, the passage 32 and its closure means may be symmetrically installed in the brattice 10 to reduce the need for precise orientation of the brattice 10 during installation. The zipper may comprise first and second zipper tracks, respectively 34 and 36, which meet at a central point 38. Thus, the passage 32 with its zipper closure is selectively openable using exactly the same procedure, regardless of the orientation of the brattice 10. (Non-symmetrical closures opening from one side toward the other may be used alternatively,) Preferably, the zipper components 34 and 36 are formed of plastic or other non-metallic material, to reduce the possibility of spark production in a potentially explosive environment in a mine emergency.

Additional peripherally disposed passages may be provided adjacent the peripheral spring member 14 of each brattice 10 for ventilation ducts V, cables, etc., as desired. Such passages 40 may be selectively closed by means of mating hook and loop fastening material 42, as in the left hand brattice 10 of FIG. 1, or may comprise passages 44 using zipper closures 46, as in the right hand brattice 10 of FIG. 1. Other closure means may be provided as desired, but for most purposes, it is desirable that the brattices 10 and their various features be devoid of metal or metallic components, for the reasons discussed further above. These peripheral passages 40 and 44 are preferably symmetrically disposed about the peripheries of the brattices 10, in order to make their orientation uncritical at installation.

Figure 2:
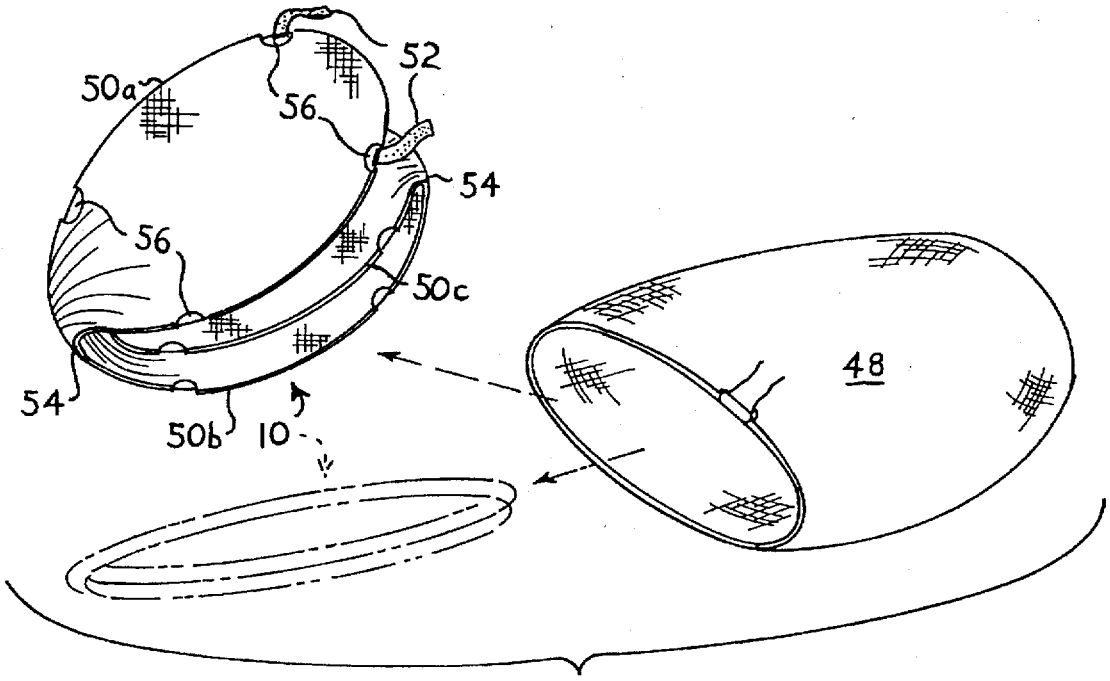
FIG. 2 is an exploded perspective view of a partially unfolded brattice of the present invention being withdrawn from a storage container therefor, with a second brattice shown in broken lines.
Figure 3:
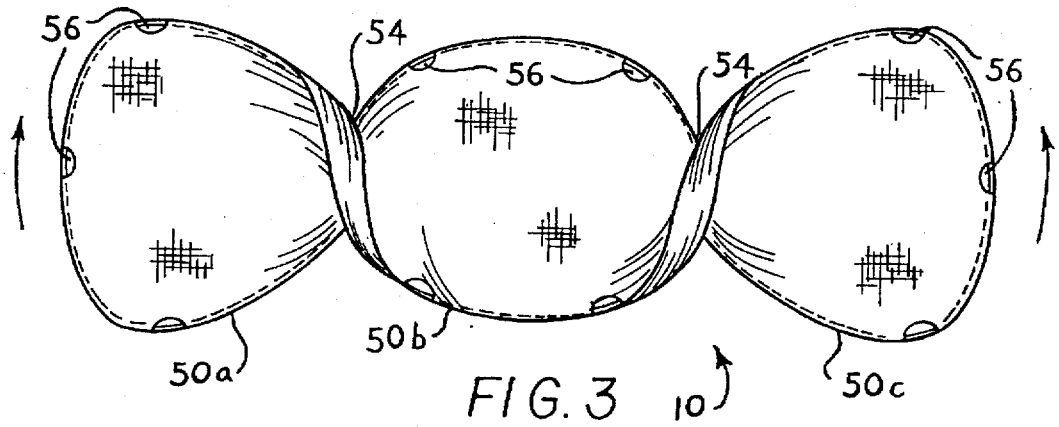
FIG. 3 is a view of the unfolded but twisted brattice of FIG. 2, showing the peripheral spring bias urging the brattice to a fully extended position from its twisted state.

Due to the flexible nature of the peripheral spring 14 and the thin, flexible brattice curtain 12 of the present brattices 10, they may be folded for storage to a diameter much smaller than their expanded open diameter, as shown in FIGS. 2 and 3. Due to the light weight of each brattice 10, several such brattices 10 (one of which is shown in solid lines, with another being shown schematically in broken lines) may be stored and carried easily in a storage container or bag 48, as shown in FIG. 2. The brattices 10 may be twisted and folded over upon themselves two or more times, depending upon their unfolded diameter, the resilience of the peripheral spring 14, the thickness of the brattice curtain 12 material, and the size of the storage bag or container 48.

In FIG. 2, a pair of brattices 10 are shown being withdrawn from a storage container 48, with the three portions 50*a*, 50*b*, and 50*c* formed by the twisted folds of the upper brattice 10 of the figure being shown. The resilient spring nature of the peripheral spring frame 14 will urge the brattice 10 to an expanded position as the brattice 10 is withdrawn from the storage bag 48. The brattice 10 may be retained in a folded configuration for insertion into the bag 48 by means of one or more securing straps 52 of hook and loop fastening material, or other means as desired.

As the brattice 10 is withdrawn and any retaining straps 52 unfastened, the folded portions 50*a*, 50*b*, and 50*c* of the brattice 10 will tend to unfold naturally to an intermediate configuration as shown in FIG. 3. (Again, it should be understood that the three folded portions shown in FIGS. 2 and 3 are exemplary, and that a greater or lesser number of folded panels may be used store a brattice 10 of the present invention.) The 180 degree half twist 54 formed between each of the portions 50*a*, 50*b*, and 50*c*, will naturally tend to untwist due to the expansive force within the peripheral spring member 14, to form a fully expanded brattice 10 as shown in FIG. 1.

It will be seen that the above operation will occur quite rapidly when the brattice 10 is removed from its container 48 and any securing means 52 unfastened. The brattice 10 will "pop" into a fully extended configuration, and may be quickly wedged into place, perhaps along with another brattice(s) 10, at the desired location in a drift D to provide temporary ventilation control.

The present brattice 10 may be retained within the drift D by means of the expansive force of the peripheral spring 14 against the walls, ceiling, and floor of the drift D, depending upon the force developed by the spring 14, the air pressure differential on each side of the brattice 10, the degree of fit of the brattice 10 with the drift D, and other considerations. Additional security may be provided by the peripheral extension 16 discussed further above, and/or by means of the roof bolts and their plates P conventionally installed in mines for reinforcement. These plates P are conventionally provided with an ear or lug having a hole therethrough, which may be used to secure or tie various articles (supply lines of various sorts, ducts, etc.) to the ceiling of the drift in order to keep the floor clear.

Figure 4:
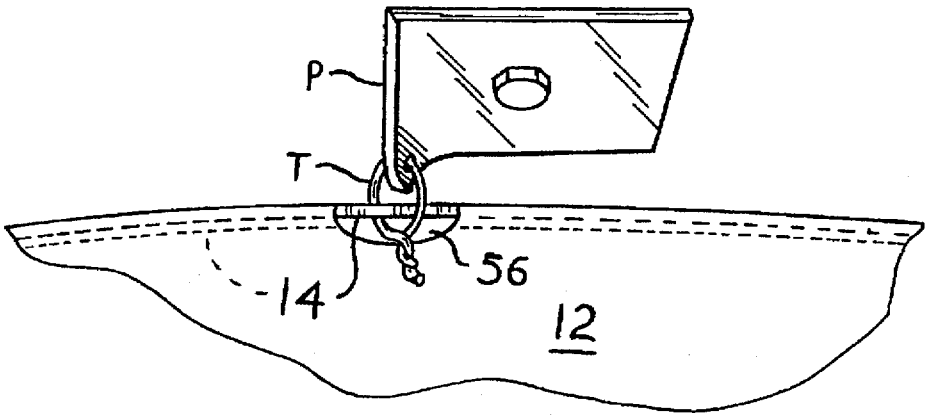
FIG. 4 is a fragmented detail view showing one means of securing the present temporary or emergency brattice to a roof plate.
Figure 5:
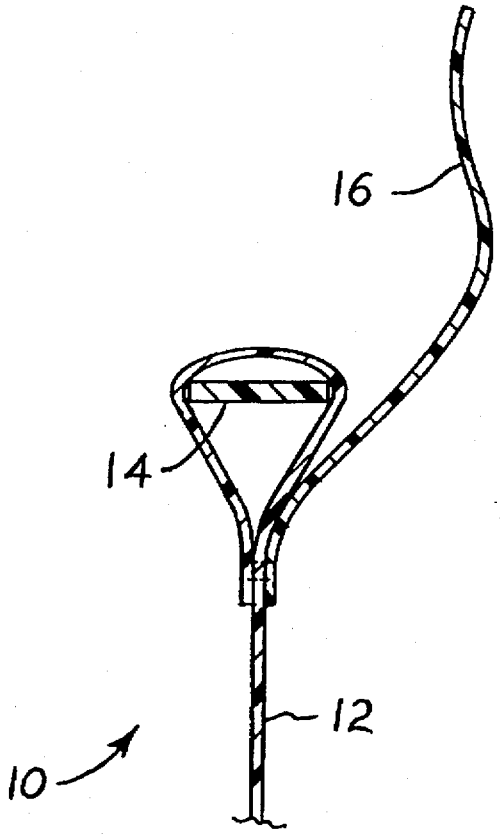
FIG. 5 is a fragmented detail view in section of the peripheral spring member of the present brattice, and the brattice curtain extension.

These plates P may also be used to secure the present brattices 10 thereto, by means of a twist tie or plastic wire bundle tie T (e. g., Ty-Rap, tm), as shown in FIG. 4. Cutouts or reliefs 56 may be provided about the periphery of the brattice allowing such ties T to be passed around the peripheral spring member 14. Alternatively, the thin, lightweight nature of the brattice curtain 12 allows it to be penetrated easily, and such ties may be punched through the material at the location(s) desired. Thus, the brattice(s) 10 may be quickly wedged into position as desired, and further secured at that time or at a later time as needed, using the brattice curtain extension 16 and/or ties T as needed and in accordance with the structure and provisions of the specific location where the brattice(s) 10 is/are installed.

While the present brattice(s) 10 are by no means air tight and do not provide an absolute seal, they do serve quite well as a temporary ventilation control device in emergency and non-emergency situations in mining. The ability of two or more brattices 10 to be secured together, e. g., by means of mating hook and loop fastening material, enables relatively large openings to be spanned very quickly where time is critical, as shown in FIG. 6 by the four brattices 10*a*. The various passages which may be provided through the various embodiments of the present brattices 10, allow emergency workers, rescue teams, and/or other personnel to pass through as required to perform their duties, and to carry supplies and remove rescued personnel as needed.

When more permanent ventilation control brattices are installed, the present brattices 10 may be removed and twistably folded for storage, in the reverse of the operation shown in FIGS. 2 and 3 and discussed further above. However, it will be seen that the present brattices 10 may be constructed very inexpensively, costing only a few dollars each. Thus, it may be economically advantageous to discard them after use, rather than taking the time to refold and repack them into a storage container, and/or to carry them out to the surface.

In summary, the above described temporary brattices 10 will be seen to provide a much needed alternative to the conventional brattice curtains and telescoping sticks heretofore used in mine emergency operations. The present temporary brattices 10 may be installed very quickly, and are at least as impervious, if not more so, as the conventional brattice curtains with their peripheral gaps. The peripheral spring member 14 of the present brattices serves to urge the attached brattice curtain 12 outwardly against the surface of the drift in which the brattice 10 is installed, with little or no gap therebetween, depending upon the regularity of the drift surface and other factors. The peripheral extension flap 16, which may be provided with the present brattices 10, provides additional sealing as needed. The passages which may be provided through the brattices 10, enable various articles and personnel to pass therethrough as needed, and the inexpensive construction of the present brattices 10 provides for their economic disposal after a single use, if it is not desired that they be folded and stored for future use.

However, the present brattices 10 will be seen to be worth whatever their cost may be, due to the extreme rapidity with which they may be unfolded to pop into an extended configuration and quickly wedged into position due to their peripheral spring members- Also, their extremely light weight enables rescue personnel to proceed more quickly than if they were burdened with heavier loads. The saving of several seconds each over the installation of perhaps several hundred such brattices in a mine emergency, and the greater speed attainable by rescue personnel., can result in a savings of time of perhaps a few hours during the course of rescue operations, which time can be critical in lifesaving operations, as noted earlier in the present disclosure.

While emphasis has been placed upon the suitability of the present brattice for use in emergency situations, it will be seen that it is also highly suited for use as a temporary brattice in non-emergency situations. According to regulations, such temporary brattices may be installed in routine, non-emergency situations where ventilation control is needed in a mine, for up to 72 hours. The present brattice is well suited for such use in addition to its suitability as an emergency device.

The present brattices may be provided as an emergency kit comprising two or more brattices and sealant in a storage container, and made available to workers as personal gear and/or at strategically located points throughout the mine. Such an emergency kit would enable a worker to seal himself or herself in a temporary emergency enclosure in the event of a mine emergency and release of gas within the mine. It has been noted above that the present brattice may be formed of a porous material and that some leakage will occur about the edges of the spring periphery, but a coated, non-porous fabric material and the use of a sealant with or without the peripheral extensions will form an essentially leakproof emergency closure which may be rapidly installed in an emergency, as needed. Whether for routine temporary use or for emergency use, the present brattice in its various embodiments will be seen to be of great value in the mining industry.

It is to be understood that the present invention is not limited to the sole embodiments described above, but encompasses any and all embodiments within the scope of the following claims.

I claim:

1. A brattice for temporary and emergency use in underground mining, comprising:

a brattice curtain formed of a thin, flexible, lightweight, and fire resistant sheet of material, with said curtain having a periphery therearound with a peripheral spring member installed within said periphery of said brattice curtain, and;

said peripheral spring member providing an expanding force urging said brattice curtain to a fully extended configuration for temporary and emergency mine ventilation control, and further being twistably foldable to a folded position providing for the compact storage of said brattice.

2. The brattice according to claim 1, wherein:

said brattice curtain has a first surface and an opposite second surface, with each said surface having hook and loop fastening material disposed thereover in a pattern adapted to secure one said brattice to another as desired.

3. The brattice according to claim 2, wherein:

said hook and loop fastening material is disposed in a pattern of diagonal strips of material adapted to provide uncritically aligned mating contact of one said brattice to another.

4. The brattice according to claim 1, including:

at least one passage through said brattice curtain, and selectively operable closure means for said passage.

5. The brattice according to claim 4, wherein:

said at least one passage is centrally disposed through said brattice curtain and includes a passage center, and said closure means is symmetrically disposed about said passage center to provide for the selective opening of said passage along said closure means in any direction from said passage center.

6. The brattice according to claim 4, including:

a plurality of passages symmetrically disposed about said brattice curtain and adjacent said peripheral spring member.

7. The brattice according to claim 4, wherein:

said closure means is selected from the group consisting of zippers and mating hook and loop fastening material.

8. The brattice according to claim 1, including:

a brattice curtain extension extending beyond said peripheral spring member of said brattice.

9. The brattice according to claim 1, including:

a lightweight and compact storage container adapted to store at least one said brattice removably therein.

10. The brattice according to claim 1, wherein:

said brattice curtain is formed of a ripstop synthetic fabric material, said peripheral spring member is formed of a non-metallic material, and said brattice is devoid of metal components.

11. A method of using a temporary and emergency brattice for underground mining, comprising the following steps:

(a) providing a brattice comprising a brattice curtain formed of a thin, flexible, lightweight, and fire resistant sheet of material with a peripheral spring member installed about the periphery of the brattice curtain, with the spring member providing an expanding force urging the brattice curtain to a fully extended configuration and further being twistably foldable to a folded position providing for the compact storage of the brattice;

(b) unfolding and untwisting the spring member to allow the spring member to expand the brattice curtain to a fully extended configuration, and;

(c) removably installing the brattice in a drift within the mine at the location desired, with the peripheral spring member bearing against the surface of the drift to secure the brattice in place to provide temporary and emergency ventilation control within a mine.

12. The method of using a brattice according to claim 11, including the steps of:

(a) placing mating hook and loop fastening material over the brattice curtain, and;

(b) removably securing one brattice to another as desired to span a drift opening larger than a single brattice.

13. The method of using a brattice according to claim 11, including the steps of:

(a) providing at least one passage through the brattice curtain, and;

(b) further providing selectively operable closure means for the passage.

14. The method of using a brattice according to claim 11, including the steps of:

(a) providing a brattice curtain extension extending beyond the peripheral spring member of the brattice, and;

(b) tucking the brattice curtain extension into any irregular gaps between the brattice periphery and the surface of the drift into which the brattice has been temporarily installed, thereby providing better sealing for the temporary and emergency brattice.

15. The method of using a brattice according to claim 11, including the steps of:

(a) providing a lightweight and compact storage container adapted to store at least one brattice removably therein, and;

(b) removing the at least one brattice from the storage container, and;

(c) temporarily installing the brattice as desired.

16. The method of using a brattice according to claim 15, including the steps of:

(a) removing the at least one brattice when the temporary ventilation control is no longer required;

(b) twistably folding the peripheral spring member and brattice curtain therein to a compact storage configuration, and;

(c) returning the at least one twistably folded brattice to the storage container for storage until further use is needed.

17. The method of using a brattice according to claim 11, including the steps of:

(a) forming the brattice of a ripstop synthetic fabric material, and;

(b) forming the peripheral spring member of a non-metallic material devoid of metal components.

* * * * *